US007488128B2

(12) United States Patent
Aruga et al.

(10) Patent No.: US 7,488,128 B2
(45) Date of Patent: Feb. 10, 2009

(54) IMAGE RECORDING APPARATUS AND IMAGE RECORDING METHOD OF THE IMAGE RECORDING APPARATUS

(75) Inventors: Toshinao Aruga, Akiruno (JP); Keiichiro Tawara, Hachioji (JP); Naoki Ishii, Inagi (JP)

(73) Assignee: Olympus Corporation, Tokyo (JP)

( * ) Notice: Subject to any disclaimer, the term of this patent is extended or adjusted under 35 U.S.C. 154(b) by 594 days.

(21) Appl. No.: 11/155,434

(22) Filed: Jun. 17, 2005

(65) Prior Publication Data

US 2005/0280843 A1 Dec. 22, 2005

(30) Foreign Application Priority Data

Jun. 21, 2004 (JP) ..... 2004-182509

(51) Int. Cl.
*B41J 29/00* (2006.01)
*B41J 2/00* (2006.01)

(52) U.S. Cl. ..... 400/708; 347/14; 358/1.8; 358/448

(58) Field of Classification Search ..... 400/708; 347/14, 16, 100, 110, 147; 358/1.8, 448
See application file for complete search history.

(56) References Cited

U.S. PATENT DOCUMENTS 6,234,606 B1 * 5/2001 Suzuki ..... 347/43
2006/0055718 A1 * 3/2006 Endo et al. ..... 347/14

FOREIGN PATENT DOCUMENTS

JP 2002-120386 A 4/2002

* cited by examiner

*Primary Examiner*—Daniel J. Colilla
*Assistant Examiner*—Marissa L Ferguson-Samreth
(74) *Attorney, Agent, or Firm*—Frishauf, Holtz, Goodman & Chick, P.C.

(57) ABSTRACT

The invention provides an image recording apparatus comprising a recording unit in which at least two recording heads are disposed such that end portions of respective nozzle columns overlap each other in a recording medium conveying direction or such that the nozzle columns are located adjacent to each other at a predetermined interval, the image recording apparatus executing recording position recording medium width-direction moving processing for a detected deviation (lateral deviation amount) of a recording medium at both-lateral ends of the recording medium, image data distribution processing with a joint of the overlapping as a boundary, image-recording density-varying processing for the joint, and recording position recording medium conveying-direction moving processing in order to perform high quality image jointing processing, and an image recording method of the image recording apparatus.

19 Claims, 14 Drawing Sheets

IMAGE RECORDING APPARATUS AND IMAGE RECORDING METHOD OF THE IMAGE RECORDING APPARATUS

CROSS-REFERENCE TO RELATED APPLICATIONS

This application is based upon and claims the benefit of priority from prior Japanese Patent Application No. 2004-182509, filed Jun. 21, 2004, the entire contents of which are incorporated herein by reference.

BACKGROUND OF THE INVENTION

1. Field of the Invention

The present invention relates to an image recording apparatus which records an image by moving a recording position of image data to be recorded on a recording medium as an image corresponding to a positional deviation of a conveyed recording medium (for example, recording paper), and an image recording method of the image recording apparatus.

2. Description of the Related Art

In a recording head of each color provided on a general consumer color ink jet printer, a nozzle column composed of plural nozzles for ejecting ink in a direction which conforms to a conveying direction (or called Y direction) of a recording medium is formed and mounted on a carriage. Hereinafter, a direction perpendicular to the conveying direction of the recording medium is called width direction of the recording medium (or called X direction). If ink of each color is ejected to the recording medium while the carriage is reciprocated for scanning in the width direction of the recording medium, a color image or the like is recorded on the recording medium. This type of the color ink jet printer is called serial type.

An available printer of different type from the serial type includes an ink jet printer having the same number of recording heads as that of prepared colors, in which a nozzle column having the width of the recording medium or longer is equipped along the X direction. In this ink jet printer, each recording head is disposed and fixed above a conveyed recording medium, and when the recording medium passes below the nozzle column of the recording heads, ink of each color is ejected from each recording head so as to record a color image or the like. Such a color ink jet printer is called full line type.

This full line type ink jet printer includes one disclosed in, for example, Jpn. Pat. Appln. KOKAI Publication No. 2002-120386. According to the ink jet printer, plural recording heads whose nozzle column is relatively short are disposed in a staggered manner so as to be departed back and forth in the Y direction at a predetermined distance, while extended over a length not shorter than the width of the recording medium along the X direction. Further, as for this disposition, the nozzle columns in short-length recording heads adjoining each other in the Y direction partially overlap. With the overlapping, no gap (portion at which no ink is ejected) occurs in, for example, a 1-line image formed by each recording head. As an example of the disposition of such recording heads, as shown in, for example, FIG. 17, three short-length recording heads disposed with a predetermined distance in the X direction (including K1 recording head) and three short-length recording heads disposed with a predetermined distance in the X direction (including K2 recording head) are arranged in two columns with a predetermined separation distance (nozzle column deviation amount) in the Y direction.

In image data developed on the short-length recording head having such a configuration, plural 1-line image data recorded in the X direction are developed in plural quantities in the Y direction without any gap (two-dimensional development). On the other hand, an image data memory is used for processing of image data composed of plural 1-line image data (data write or read out of written data), so that image data to be processed is stored so as to be developed to a row and a column in a two-dimensional map.

The image data is stored such that the one-line data items are recorded in the same row, each one-line item in the column direction, depending on the storage capacity of the image data memory.

In the above-described ink jet printer having the short-length recording heads loaded thereon, an image of the 1-line image data must be recorded by driving the three short-length recording heads (including K1 recording head) at an ink ejection timing $\alpha$1 and driving the other three short-length recording heads (including K2 recording head) at an ink ejection timing $\alpha$2.

The recording medium can be conveyed in a shift laterally (X direction) as shown in FIG. 18 because of a conveyance error or the like of the conveying mechanism. In the ink jet printer, its image recording position needs to be controlled by moving corresponding to the lateral deviation amount of the recording medium.

If the image is recorded on a recording medium deviated laterally, even a nozzle in the short-length recording head not opposing any recording medium due to the lateral deviation ejects ink. A conveying member such as a conveying belt of the conveying mechanism is stained by this ink. The stain of the conveying member adheres to a non-image recording face (face on which no image is recorded at the time of single-face image recording) of the recording medium, thereby causing contamination.

The 1-line image data is formed with plural short-length recording heads in the ink jet printer shown in FIG. 18. Therefore, the control method is different from the control in image recording of an ordinary ink jet printer whose nozzle column is not shorter than the width of the recording medium. That is, since, according to the image recording control of the ink jet printer, the nozzle columns of the short-length recording heads are disposed in a shift in the Y direction, image recordings at different ink ejection timings $\alpha$1 and $\alpha$2 are necessary.

On the other hand, since the three short-length recording heads (including K1 recording heads) and the three short-length recording heads (including K2 recording head) are disposed in a shift back and forth in the Y direction, the 1-line image data needs to be distributed to image data to be recorded at the ink ejection timing $\alpha$1 and image data to be recorded at the ink ejection timing $\alpha$2 at a joint of respective nozzle columns of adjoining recording heads.

Therefore, the 1-line image data in FIG. 18 is comprised of image data for the three short-length recording head including the K1 recording head and image data for the three short-length recording head including the K2 recording head.

In the case where the image recording is carried out by using the short-length recording heads disposed such that the end portions of the respective nozzle columns overlap each other in the Y direction as shown in FIG. 18, it is necessary to execute image-recording density-varying processing for making a joint in a recorded image at a portion in which nozzle columns of the adjoining recording heads join less conceivable.

The term "image-recording density" means the optical density of the image formed on the recording medium by applying ink droplets from the recording nozzles onto the recording medium.

If the density-varying processing is not carried out, the joint portion receives ink ejection in duplicate from two short-length recording heads while the other portion than the joint portion receives ink ejection from a single short-length recording head, and therefore, there is a fear that a stripe-like difference in density may be found in the recorded image.

As described above, the image recording apparatus carries out the full line image recording by using plural short-length recording heads disposed so as to form an image as if their nozzle columns are connected in line in the width direction of the recording medium. The image recording apparatus requires X-direction recording position moving processing to meet a deviation of the conveying position of the recording medium, image data distribution processing for distributing image data with a joint of the full line image as a boundary, and density-varying processing for making a joint of a partial image recorded by the short-length recording head less conceivable.

BRIEF SUMMARY OF THE INVENTION

According to one aspect of the present invention, there is provided an image recording apparatus comprising: a conveying mechanism having a conveyance information generating section which, when a recording medium is mounted and conveyed in a conveying direction, generates conveyance information of the recording medium; at least one recording unit having a recording head drive circuit, in which a plurality of recording heads each having a plurality of nozzles in a direction perpendicular to the conveying direction are disposed such that their end portions adjoining each other in the perpendicular direction are located on a straight line or the plurality of recording heads are disposed such that their end portions adjoining each other are departed at a predetermined distance in the conveying direction, while monochromatic ink is ejected from the plurality of nozzles; a recording medium front end detecting section which detects a front end of the recording medium; a recording medium both-lateral ends detecting section which detects both-lateral ends of the recording medium; and an integral control section which controls the conveying mechanism and controls the recording unit based on information from the conveyance information generating section, the recording medium front end detecting section and the recording medium both-lateral ends detecting section, thereby recording image data on the recording medium as an image.

According to another aspect of the present invention, there is provided an image recording method of an image recording apparatus in which, by means of: a conveying mechanism having a conveyance information generating section which, when a recording medium is loaded and conveyed along a Y direction, generates conveyance information of the recording medium; and at least one recording unit in which a plurality of recording heads each having a plurality of nozzles in an X direction perpendicular to the Y direction are disposed according to a first disposition in the plurality of recording heads having a plurality of nozzles in a direction perpendicular to the conveying direction are disposed such that their end portions adjoining each other in the perpendicular direction are located on a straight line or a second disposition in which the plurality of recording heads are disposed such that their end portions adjoining each other are departed at a predetermined distance in the conveying direction, the at least one recording unit ejecting a monochromatic ink from the plurality of nozzles, image recording is executed in a process of conveying the recording medium with the conveying mechanism based on inputted image data, the image recording method comprising: storing at least first information concerning an ink ejection timing of a first recording head and second information concerning an ink ejection timing of a second recording head in the plurality of recording heads before the image recording is started; detecting a front end of the recording medium conveyed in the Y direction after the image recording is started; detecting both-lateral ends of the conveyed recording medium in the X direction; obtaining a boundary position in the X direction for distributing the image data to the first recording head and the second recording head disposed according to the first disposition or the second disposition from a result of the detection on the both-lateral ends; distributing the image data to first image data and second data and storing at the obtained boundary position; reading out the first image data and the second image data by shifting their read timings only by an amount of line image data corresponding to a difference in the ink ejection timing between the first information and the second information, based on the conveyance information; and recording an image on the recording medium by the first recording head and the second recording head.

According to another aspect of the present invention, there is provided an image recording method of an image recording apparatus in which, by means of: a conveying mechanism having a conveyance information generating section which, when a recording medium is loaded and conveyed along a Y direction, generates conveyance information of the recording medium; and at least one recording unit in which a plurality of recording heads each having a plurality of nozzles in an X direction perpendicular to the Y direction are disposed according to a first disposition in the plurality of recording heads having a plurality of nozzles in a direction perpendicular to the conveying direction are disposed such that their end portions adjoining each other in the perpendicular direction are located on a straight line or a second disposition in which the plurality of recording heads are disposed such that their end portions adjoining each other are departed at a predetermined distance in the conveying direction, the at least one recording unit ejecting a monochromatic ink from the plurality of nozzles, image recording is executed in a process of conveying the recording medium with the conveying mechanism based on inputted image data, the image recording method comprising: storing at least first information concerning an ink ejection timing of a first recording head and second information concerning an ink ejection timing of a second recording head in the plurality of recording heads before the image recording is started; detecting a front end of the recording medium conveyed in the Y direction after the image recording is started; detecting both-lateral ends of the conveyed recording medium in the X direction; obtaining a boundary position in the X direction for distributing the image data to the first recording head and the second recording head disposed according to the first disposition or the second disposition from a result of the detection on the both-lateral ends; adding a data region only by an amount of a plurality of line image data corresponding to a difference in the ejection timing between the first information and the second information, and distributing the image data to the first image data and the second image data and storing; executing first non-image recording data region masking processing for the first image data and second non-image recording data region masking processing for the second image data based on the conveyance information; and recording the first image data and the second image data after the each non-image recording data region masking processing on the recording medium as an image by the first recording head and the second recording head based on the conveyance information.

DETAILED DESCRIPTION OF THE INVENTION

Hereinafter, an embodiment of the present invention will be described in detail with reference to the accompanying drawings.

Figure 1:
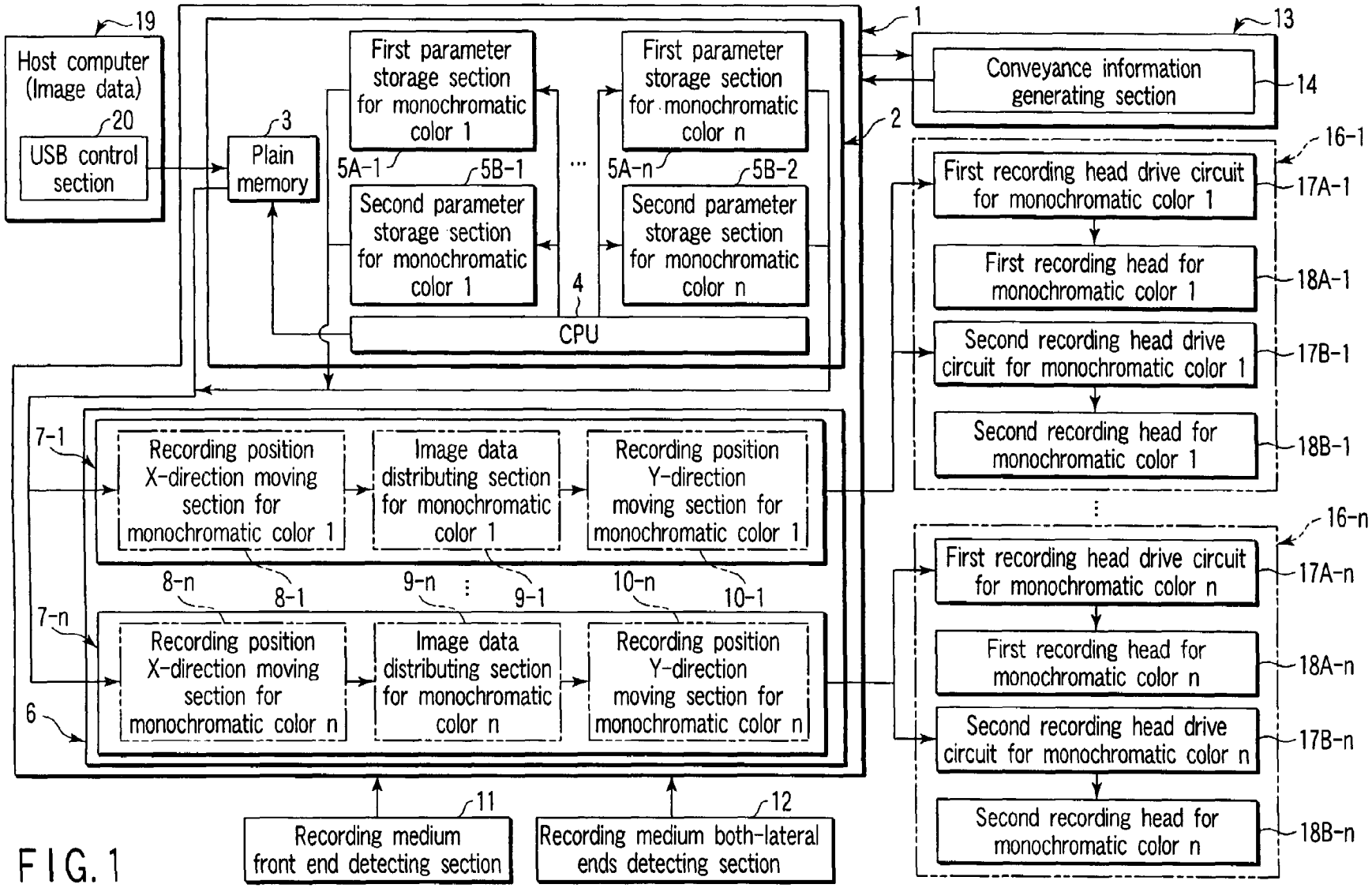
FIG. 1 is a diagram showing a conceptual configuration of an image recording apparatus according to an embodiment of the present invention.
Figure 2:
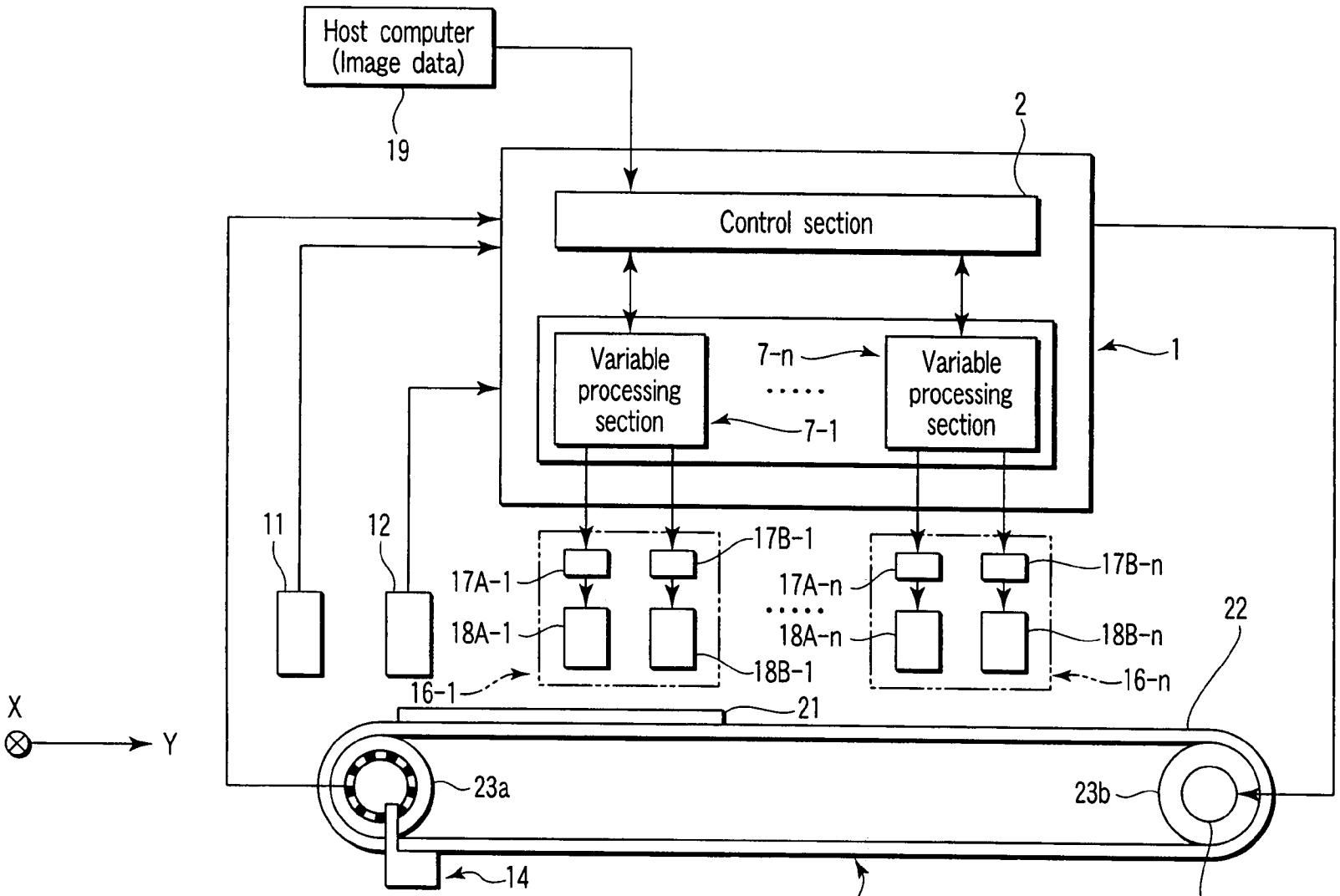
FIG. 2 is a diagram showing a conceptual configuration of the image recording apparatus (including a conveying mechanism) according to the embodiment.
Figure 17:
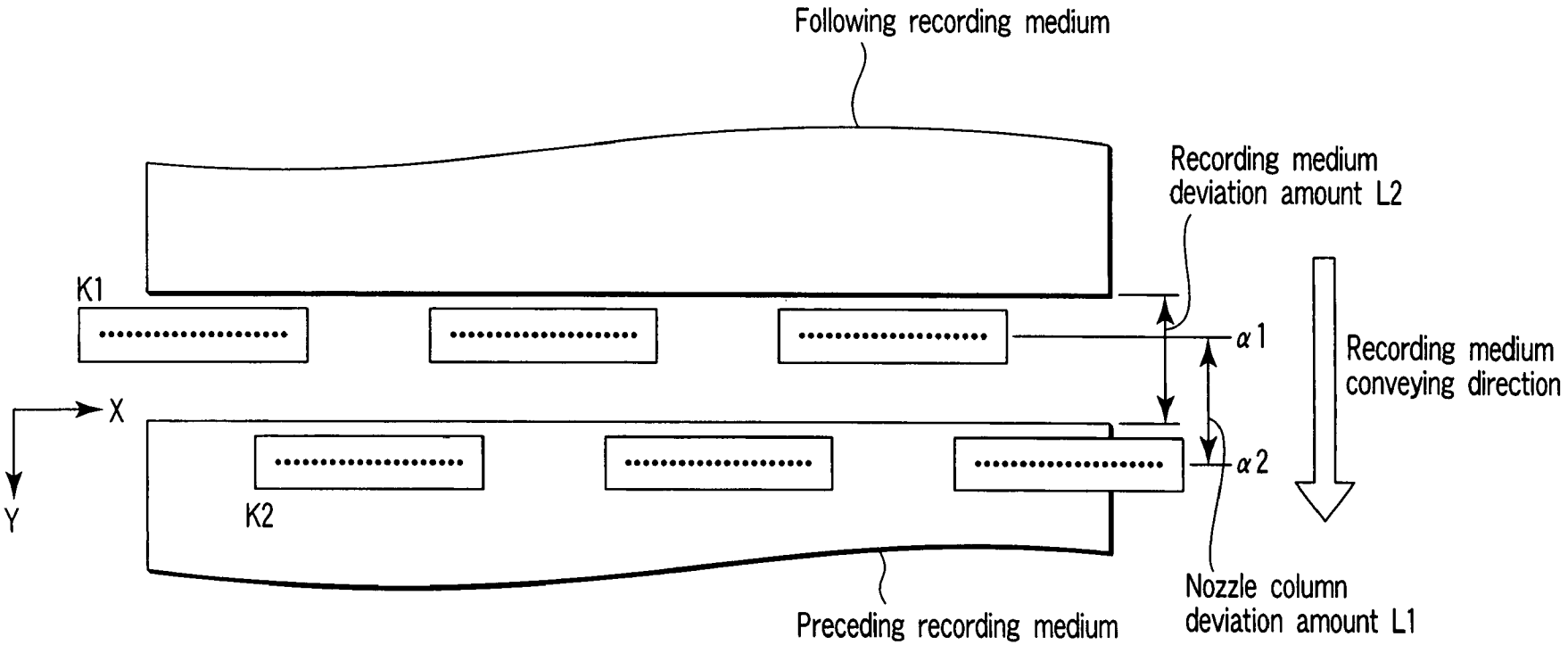
FIG. 17 is a diagram showing the positional relation between the recording medium and the recording head in the image recording apparatus employing the plural short-length recording heads.
Figure 18:
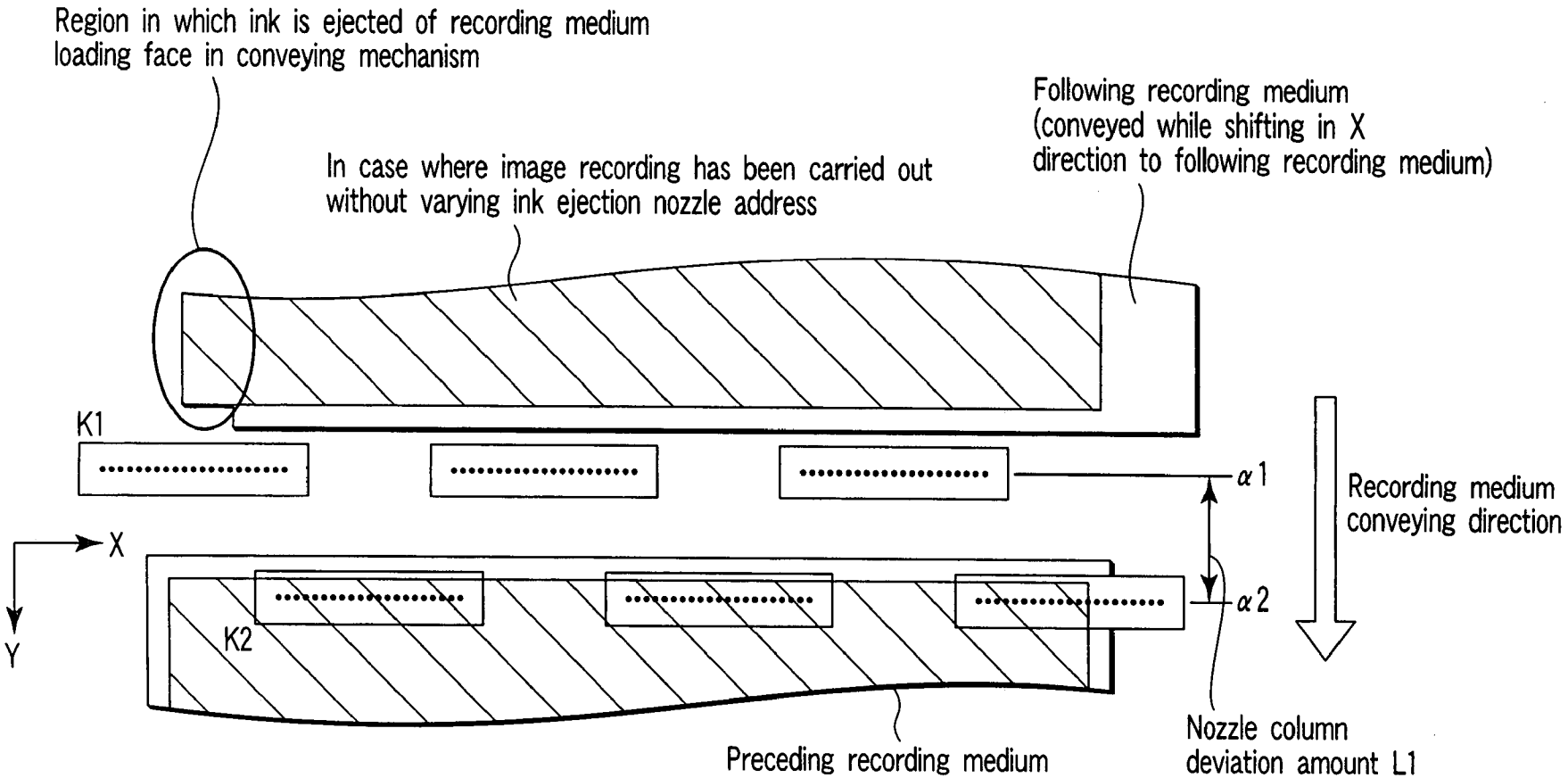
FIG. 18 is a diagram showing a state in which image recording is carried out on a recording medium deviated laterally because of a conveying error in a recording medium conveying mechanism of the image recording apparatus employing the short-length recording heads.

FIGS. 1 and 2 are diagrams showing a conceptual configuration of an image recording apparatus according to an embodiment of the present invention. Short-length recording heads shown in the figures are represented as two short-length recording heads in order to make description of the embodiment easy to understand. In practice, however, these heads are disposed in plural columns as indicated in FIGS. 17 and 18. Upon description of the present invention, a relatively short recording head whose nozzle column length does not reach the width of a recording medium is called short-length recording head. An image recorded by the short-length recording head is part of a line image to a full-line image along the width direction of the aforementioned recording medium and the full line image is recorded by the plural short-length recording heads arranged.

FIGS. 1 and 2 schematically show the configuration described below.

A conveying mechanism 13 has a conveyance information generating section 14 for generating conveyance information of a recording medium 21 when the recording medium 21 is conveyed on a conveying member 22 along a conveying direction. Two short-length recording heads 18A-1, 18B-1 eject monochromatic color 1 of a predetermined color. The respective short-length recording heads 18A-1, 18B-1 are disposed such that their end portions adjacent in the X direction are arranged on a straight line or with a predetermined distance therebetween in the Y direction. As a consequence, there is at least one joint in a 1-line image recorded by the short-length recording heads 18A1, 18B1.

A recording unit 16-1 has two drive circuits 17A-1, 17B-1 for the monochromatic color 1, which drive the two short-length recording heads 18A-1, 18B-1, respectively. Likewise, the two short-length recording heads 18A-1, 18B-n eject ink of a predetermined monochromatic color n. The n of the short-length recording head 18A-n is an integer beginning with 1, and in this case, indicates 18-1, 18-*s*, . . . 18-(n−1), 18-n. n of other number is the same.

The respective short-length recording heads 18A-n, 18B-n are disposed in the same manner as the short-length recording heads 18A-1, 18B-1, and at least one joint exists in a recorded 1-line image.

The recording unit 16-n has two driving circuits 17A-n, 17B-n for monochromatic color n, which drive the short-length recording heads 18A-n, 18B-n, respectively.

An integral control section 1 is connected to the recording units 16-1 to 16-n, a recording medium front end detecting section 11 for detecting a front end in the conveying direction of the recording medium 21, a recording medium both-lateral ends detecting section 12 for detecting both-lateral ends of the recording medium 21, and a host computer 19.

If, in the above-described configuration, for example, the respective inks of the predetermined colors are (K) black, (C) cyan, (M) magenta, and (Y) yellow, (K) black corresponds to the recording unit 16-1, (C) cyan corresponds to the recording unit 16-2, (M) magenta corresponds to the recording unit 16-3 and (Y) yellow corresponds to the recording unit 16-4. The present invention is not restricted to this configuration, but includes a configuration in which other different colors are added to the (K) black, (C) cyan, (M) magenta and (Y) yellow.

Figure 14:
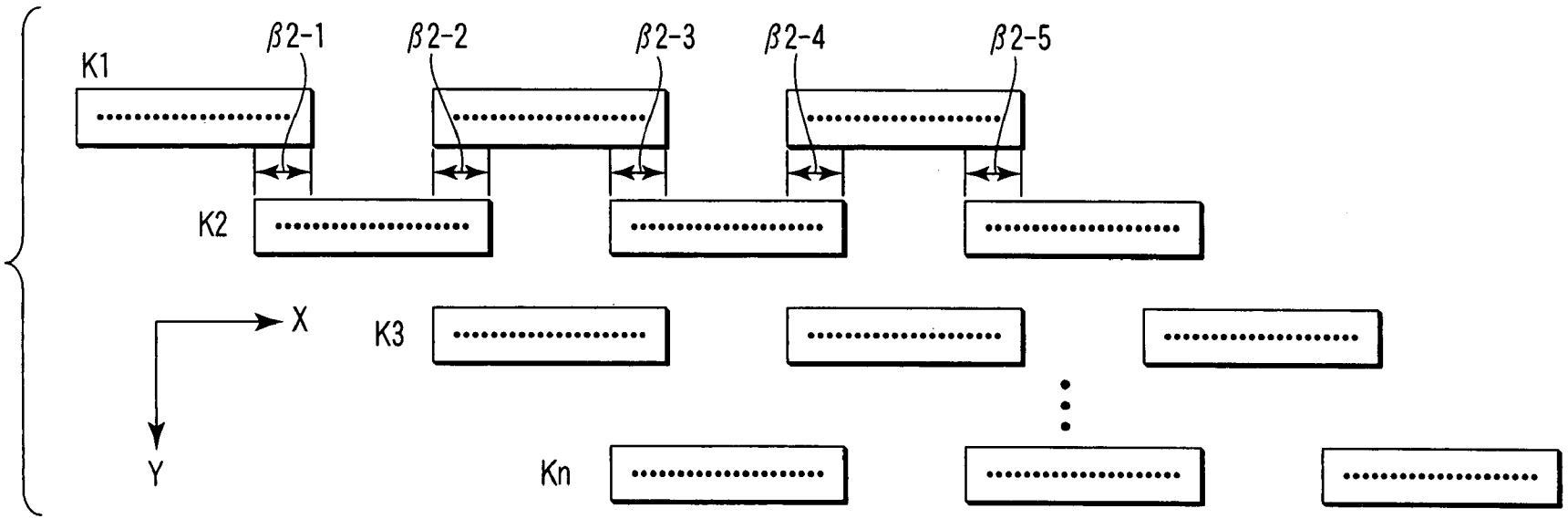
FIG. 14 is a simplified diagram when the plural short-length recording heads are disposed such that the nozzle columns overlap each other in the conveying direction.

If, as shown in FIG. 14, three short-length recording heads on a K1 nozzle column and three short-length recording heads on a K2 nozzle column are disposed with a predetermined distance in the Y direction, there are indicated five overlappings β2-1 to β2-5 on the nozzle column along the Y direction. However, the present invention is not restricted to this example, but it is permissible to extend the recording width in the X direction by using more short-length recording heads so that the number of the overlapping along the Y direction is increased.

As shown in FIG. 2, a front end of the recording medium 21 conveyed by a feed system (not shown) is detected by the recording medium front end detecting section 11 on the uppermost stream lateral of a conveying path of the recording medium 21, and the detection information 11*s* is notified to the integral control section 1. In the meantime, for example, optical reflection/transmission type sensor is employed for the recording medium front end detecting section 11.

Further, both-lateral ends of the recording medium 21 conveyed to the downstream lateral of the conveying path are detected by the recording medium both-lateral ends detecting section 12, the both-lateral ends being in the X direction perpendicular to the conveying direction, and the detection information 12*s* is notified to the integral control section 1. This detection information 12*s* indicates an amount of lateral deviation when the recording medium 21 is conveyed, and is used for extracting address information of plural nozzles which the recording medium 21 opposes when it is conveyed below nozzle columns of the recording units 16-1 to 16-n. In the meantime, for example, a line sensor or a charge coupled device (CCD) sensor is employed for the recording medium both-lateral ends detecting section 12.

In the conveying mechanism 13, for example, an endless belt in the conveying member 22 is supported by at least two rollers 23*a*, 23*b* from inlateral thereof, and the endless belt is rotated by connecting, for example, a motor 24 to a rotation shaft of the roller 23*b*. The conveying mechanism 13 is provided such that the endless belt opposes the nozzles of the recording units 16-1 to 16-n and is controlled by the integral control section 1.

Further, for example, a rotary encoder in the conveyance information generating section 14 is connected to the rotation shaft of the roller 23*a*. The conveyance information generating section 14 generates conveyance information (moving amount) of the recording medium 21 mounted on the conveying member 22 with a rotation of the roller 23*a* and notifies the integral control section 1 of the information. The integral control section 1 uses the detection information 11*s* as trigger information, and controls ejection of the respective inks in the recording units 16-1 to 16-n by synchronizing with a predetermined pulse number of the rotary encoder signal in the conveyance information generating section 14 after the trigger information is notified.

The integral control section 1 has a control section 2 and a variable processing section 6. The control section 2 comprises a plain memory 3, a first parameter storage section 5A-1 for monochromatic color 1, a first parameter storage section 5A-n for monochromatic color n, a second parameter storage section 5B-1 for monochromatic color 1, a second parameter storage section 5B-n for monochromatic color n, and a central processing unit (CPU) 4.

The plain memory 3 receives image data transmitted by the host computer 19, which is an upper level connection unit of the image recording apparatus of the present invention through a USB control section 20 or the like, and stores it. The first parameter storage section 5A-1 for monochromatic color 1, the first parameter storage section 5A-n for monochromatic color n, the second parameter storage section 5B-1 for monochromatic color 1 and the second parameter storage section 5B-n for monochromatic color n are provided corresponding to the quantity of nozzles arranged forth and back in the Y direction possessed by the recording units 16-1 to 16-n multiplied by the quantity of the recording units.

Therefore, the first parameter storage section 5A-1 for monochromatic color 1 which stores at least two parameters for the predetermined monochromatic color 1 stores an ejection timing of the first recording head 18A-1 and the second parameter storage section 5B-1 for monochromatic color 1 stores an ejection timing of the second recording head 18B-1. The first parameter storage section 5A-n for monochromatic color n which stores at least two parameters for the predetermined monochromatic color n stores an ejection timing of the first recording head 18A-n, and the second parameter storage section 5B-n for monochromatic color n stores an ejection timing of the second recording head 18B-n. These respective parameter storage sections 5A-1 to 5A-n and 5B-1 to 5B-n and the plain memory 3 are controlled by the CPU 4.

The variable processing section 6 have a variable processing section 7-1 for predetermined monochromatic color 1 to a variable processing section 7-n for predetermined monochromatic color n whose number corresponds to the number of the recording units 16-1 to 16-n. The variable processing section 7-1 for monochromatic color 1 carries out image data processing on the image data 19 of monochromatic color 1 recorded in the recording unit 16-1 and varies the image recording operation of the recording unit 16-1. The variable processing section 7-n for monochromatic color n executes image data processing on the image data 19 of monochromatic color n recorded in the recording unit 16-n and varies the image recording operation of the recording unit 16-n.

In the above-mentioned first parameter storage section 5A-1 for monochromatic color 1 and the second parameter storage section 5B-1 for monochromatic color 1, the recording unit 16-1 for ejecting ink of monochromatic color 1 (for example, (K) black) stores an ejection timing of each ink in case where, for example, two short-length recording heads (two nozzle columns) are possessed. Each ink ejection timing of the recording unit 16-1 is a set value (default value) on design of the image recording apparatus. As the set value, the rotary encoder in the conveyance information generating section 14 which uses the detection information 11*a* of the recording medium front end detecting section 11 as trigger information stores a pulse number of a generated signal.

Thus, the respective parameter storage sections 5A-1 to 5A-n and 5B-1 to 5B-n store ink ejection timings whose number corresponds to the number of short-length recording heads (nozzle columns) of the recording units multiplied by the number of the recording units preliminarily.

The CPU 4 of the control section 2 obtains the lateral deviation amount information of the recording medium 21 with respect to a nozzle position in each nozzle column of the short-length recording heads of the recording units 16-1 to 16-n when the recording medium 21 is conveyed below the recording medium both-lateral ends detecting section 12, by synchronizing with a rotary encoder signal from the conveyance information generating section 14 using the detection information 11*s* of the recording medium front end detecting section 11 as the trigger information. The lateral deviation information is sent to the variable processing section 7-1 for monochromatic color 1 and the variable processing section 7-n for monochromatic color n provided in the variable processing section 6.

The CPU 4 of the control section 2 reads out the image data 19 stored in the plain memory 3 while synchronizing with the rotary encoder signal, matches the ejection timings of the recording units 16-1 to 16-n with the lateral deviation amount information for every 1-line image data, and sends to the variable processing section 7-1 for monochromatic color 1 to the variable processing section 7-n for monochromatic color n provided in the variable processing section 6.

Next, the detail of the variable processing section 6 will be described with reference to FIG. 3.

Figure 3:
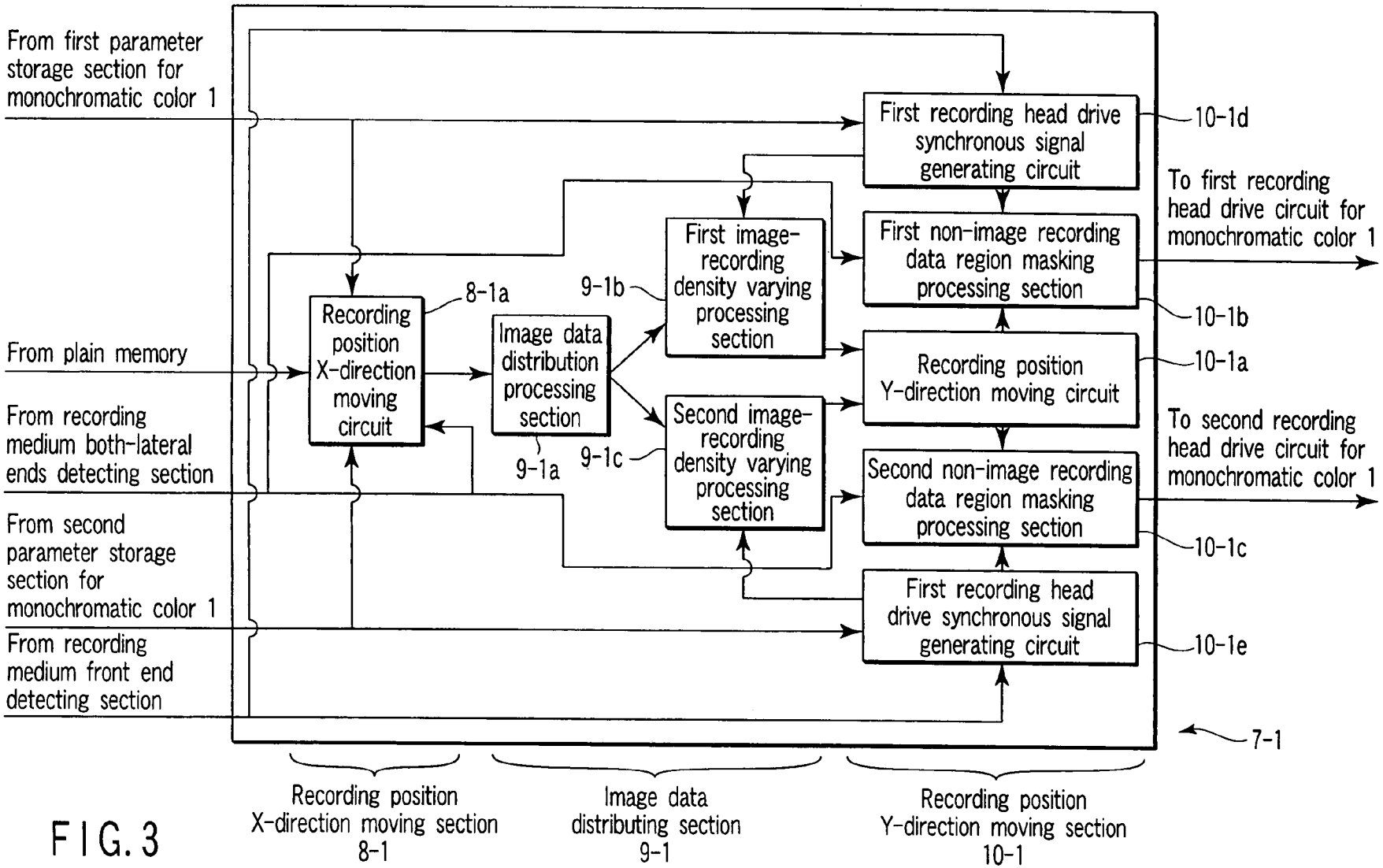
FIG. 3 is a diagram showing a conceptual block configuration of a monochromatic color-varying processing section of the image recording apparatus according to the embodiment.

FIG. 3 is a diagram showing a conceptual block configuration example of a monochromatic color variable processing section of the variable processing section 6. FIG. 3 shows the detail of the variable processing section 7-1 for monochromatic color 1 which drives the aforementioned recording unit 16-1. For the purpose of simplified explanation, FIG. 3 shows an example in which the above-described recording unit 16-1 has a first short-length recording head and second- short-length recording head in two short-length recording heads (two nozzle columns) while there is a joint in a full line image recorded.

As shown in FIG. 3, the variable processing section 7-1 for monochromatic color 1 comprises a recording position X-direction moving section 8-1 having a recording position X-direction moving circuit 8-1*a*; an image data distributing section 9-1 having an image data distribution processing section 9-1*a*, a first image-recording density-varying processing section 9-1*b* and a second image-recording density-varying processing section 9-1*c*; and a recording position Y-direction moving section 10-1 having a recording position Y-direction moving circuit 10-1*a*, a first non-image recording data region masking processing section 10-1*b*, a second non-image recording data region masking processing section 10-1*c*, a first recording head synchronous signal generating circuit 10-1*d* and a second recording head synchronous signal generating circuit 10-1*e*, so that three signal processing blocks are constituted.

First the recording position X-direction moving circuit 8-1*a* extracts each nozzle position (address information) opposing the recording medium 21 at the time of image recording based on the lateral deviation amount information of the recording medium 21, and whether ink ejection is valid or invalid is set for each nozzle based on the extracted nozzle position information. This setting prevents ink ejection to a position at which no recording medium 21 exists at the time of image recording, and white data that no ink is ejected is set for a nozzle whose ink ejection is determined to be invalid.

Figure 4:
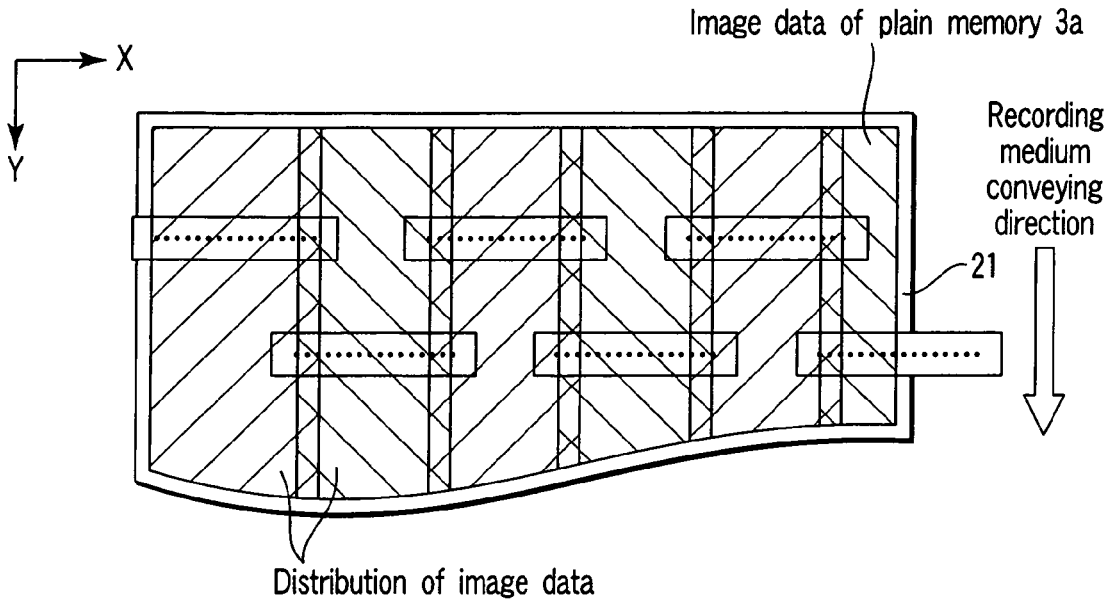
FIG. 4 is a diagram showing recording positions of image data recorded on a recording medium in a state in which the conveyed recording medium is not deviated laterally with respect to plural recording heads disposed such that respective nozzle columns overlap in a conveying direction of the recording medium.

Here, an example that the recording medium 21 deviates laterally to the right from its normal conveyance position will be described. FIG. 4 shows a positional relation between the recording medium 21 and each nozzle column of the short-length recording head and image data 3*a* recorded on the recording medium 21.

Figure 5:
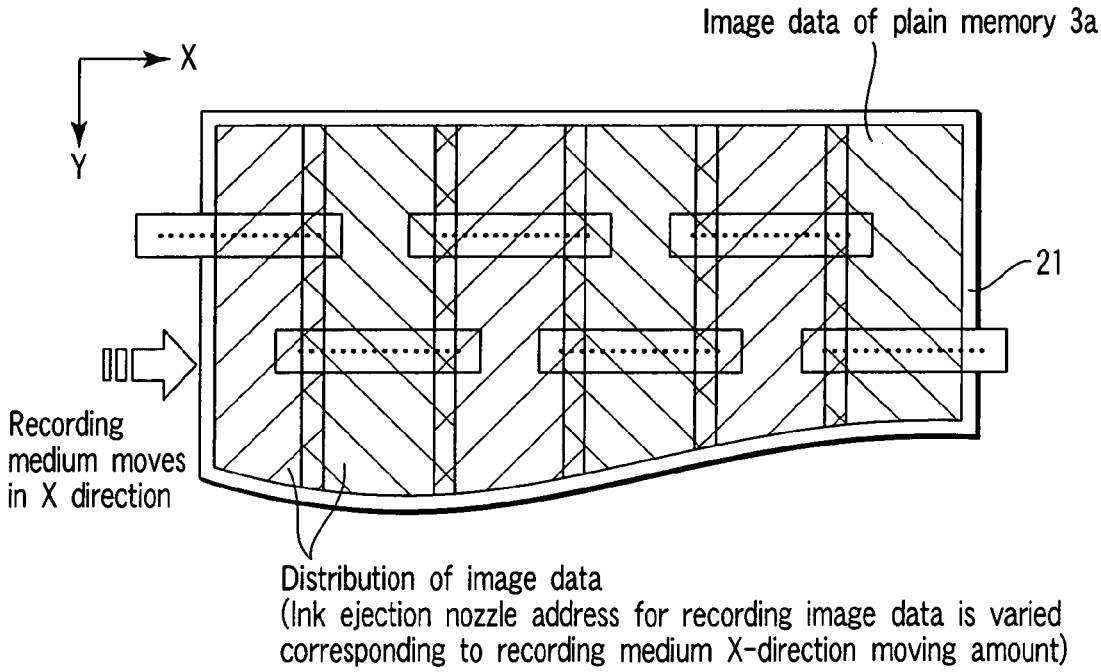
FIG. 5 is a diagram showing recording positions of image data when, in a state in which the conveyed recording medium is deviated laterally with respect to plural recording heads disposed such that respective nozzle columns overlap in the conveying direction of the recording medium, the image data recording position is moved in the X direction with respect to the laterally deviated recording medium.

On the other hand, FIG. 5 shows image data 3*a* recorded on the recording medium 21 in a state in which the recording medium 21 is deviated laterally to the right with respect to each nozzle column of the short-length recording head (moving in the X-direction).

Usually, if the positional relation between the respective nozzle columns of the short-length recording heads and the recording medium 21 shown in FIG. 4 changes to a positional relation between the nozzle columns of the short-length recording heads and the recording medium 21 shown in FIG. 5, the recording position X-direction moving circuit 8-la executes a processing of moving (shifting) an address corresponding to the plural nozzles by the lateral deviation amount to the right before recording of the 1-line image data is started. By executing the shift processing on all image data 19, the same condition as when no image recording position formed on the recording medium 21 is deviated laterally is produced. As a consequence, the recording position X-direction moving processing is completed.

Next, the image data distribution processing section 9-1*a* obtains the position of a joint of a full line image by each short-length recording head based on the processing information of the recording position X-direction moving circuit 8-1*a*, and distributes image data 19 transmitted from the plain memory 3 with the position of this joint as a border.

Next, the first image-recording density-varying processing section 9-1*b* and second image-recording density-varying processing section 9-1*c* set up the image-recording density-varying processing for each nozzle of the first recording-head and each nozzle of the second recording head located on the joint, based on each synchronous signal from the first recording head drive synchronous signal generating circuit 10-1*d* and the second recording head drive synchronous signal generating circuit 10-1*e*.

The image-recording density-varying processing varies the number of times of ink ejection for recording a single dot by each of overlapping nozzles when the two short-length recording heads are disposed such that their nozzle columns overlap each other in the Y direction on a joint of a full line image. For example, if the number of times of ink ejection of each nozzle not located on a joint of the full line image is assumed to be eight times, the number of times of ink ejection of each nozzle located on the joint of the full line image is reduced to four times, thereby adjusting a difference in density between the joint and its surrounding section. As a consequence, the distribution processing for the image data is completed.

Next, the recording position Y-direction moving circuit 10-1*a* carries out a processing of shifting each image data undergoing the distribution processing with a joint as a border just by an amount of a line image data region corresponding to a difference between the ejection timing of the first short-length recording head and the ejection timing of the second short-length recording head.

As this shifting processing, two data processing methods can be considered. For example, explanation will be given for a case where the difference between the ejection timing of the first short-length recording head and the ejection timing of the second short-length recording head is 50 pulses in terms of the pulse number of the rotary encoder signal from the conveyance information generating section 14.

According to the first data processing method, when the first image data and second image data to be distributed for storage are written into a data memory, the write data memory address (row direction) of the second image data is shifted by a 50-row address to the write data memory address of the first image data (row direction) and stored.

According to the second data processing method, the first image data and second image data to be distributed for storage are written into the data memory. When the first image data and the second image data are read out, the read-out timing is shifted by just an amount corresponding to the 50-row address after the second image data is read out, in order to read out the first image data. The processing of shifting the line image data to each other is achieved by shifting the write data memory address of the image data or shifting the read-out timing.

Next, the first non-image recording data region masking processing section 10-1*b* and the second non-image recording data region masking processing section 10-1*c* execute the non-image recording data region masking processing on an added storage region (amount of 50 rows in the previous example) at the time of the first image data storage and an added storage region (amount of 50 rows in the previous example) at the time of the second image data storage, provided by the shifting processing of the image data, based on synchronous signals of the first recording head drive synchronous signal generating circuit 10-1*d* and the second recording head drive synchronous signal generating circuit 10-1*e*.

The non-image recording data region masking processing is carried out when the size of an image data recorded on the recording medium 21 is larger than the size of the recording medium 21.

Next, after the recording position Y-direction moving processing (shifting of the full line image data region) is performed, the recording position Y-direction moving circuit 10-1*a* adds the image-recording density-varying processing to nozzles overlapping in the Y direction in the nozzle column of the first recording head and the nozzle column of the second recording head and drive the two drive circuits 17A-1, 17B-l for monochromatic color 1 of the recording unit 16-1, thereby recording an image in the first recording head 18A-1 and the second recording head 18B-1. As a consequence, the recording position Y-direction moving processing is completed.

Next, the operation of the variable processing section 7-1 for monochromatic color 1 described in FIG. 3 will be described in detail with reference to FIG. 5.

Figure 6:
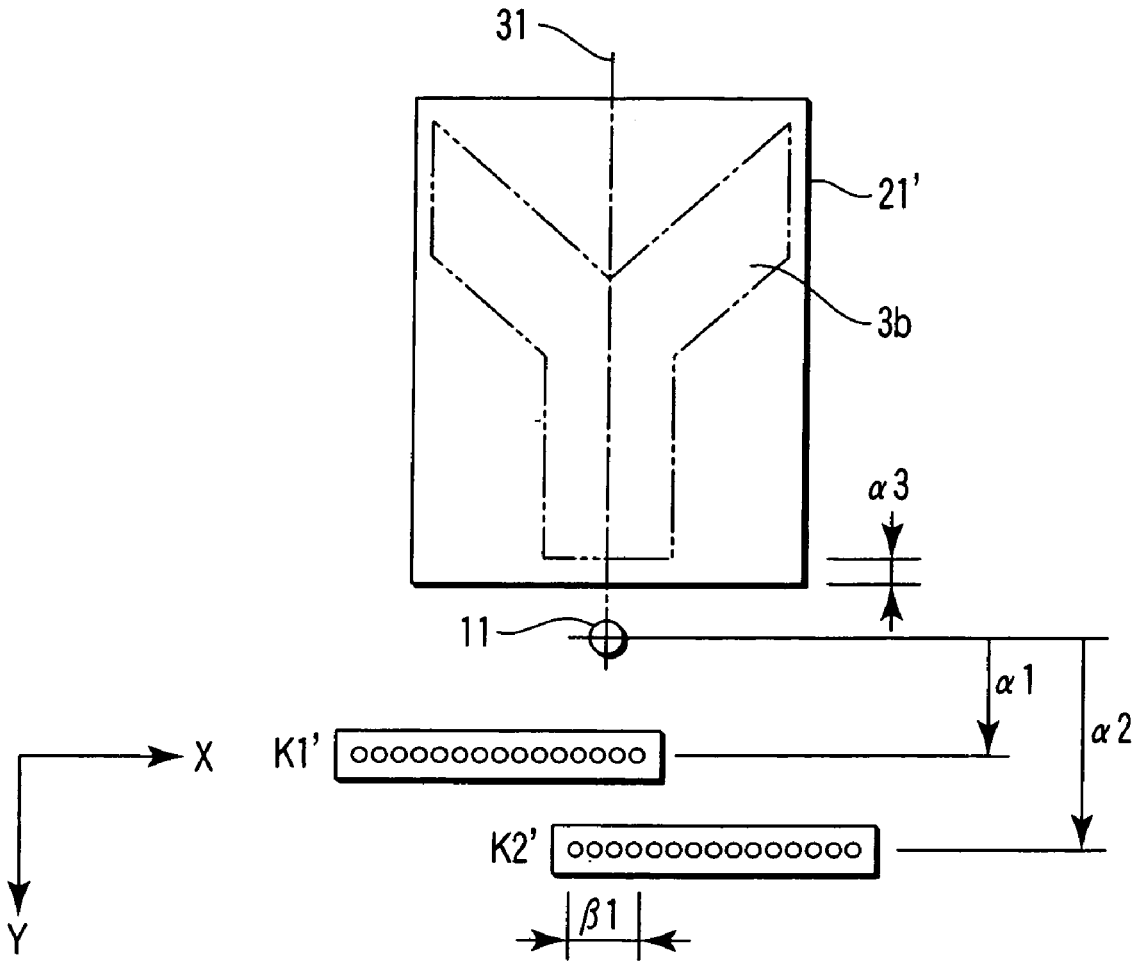
FIG. 6 is a diagram for explaining an ink ejection timing of each recording head in an image recording apparatus in which respective nozzle columns of two short-length recording heads are disposed such that they overlap in the conveying direction of the recording medium.

FIG. 6 shows substantially Y-shaped image data 3*b* with two dot and dash line (imaginary line) around a center line 31 on a recording medium 21', and a recording medium front end detecting section 11 in the upstream of the recording unit conveying path.

According to FIG. 6, a K1' recording head is disposed at a position apart by a predetermined pulse number α1 generated by the rotary encoder in the conveyance information generating section 14 of the conveying mechanism 13 (not shown) from the recording medium front end detecting section 11 in the downstream of the conveying path, and a K2' recording head is disposed at a position apart by α2, so that a joint β1 in the full line image is generated by the overlapping of the nozzle columns. α3 in FIG. 6 shown in FIG. 6 indicates an allowance distance in the conveying direction of the image data 3*b* recorded on the recording medium 21'.

Figure 7B:
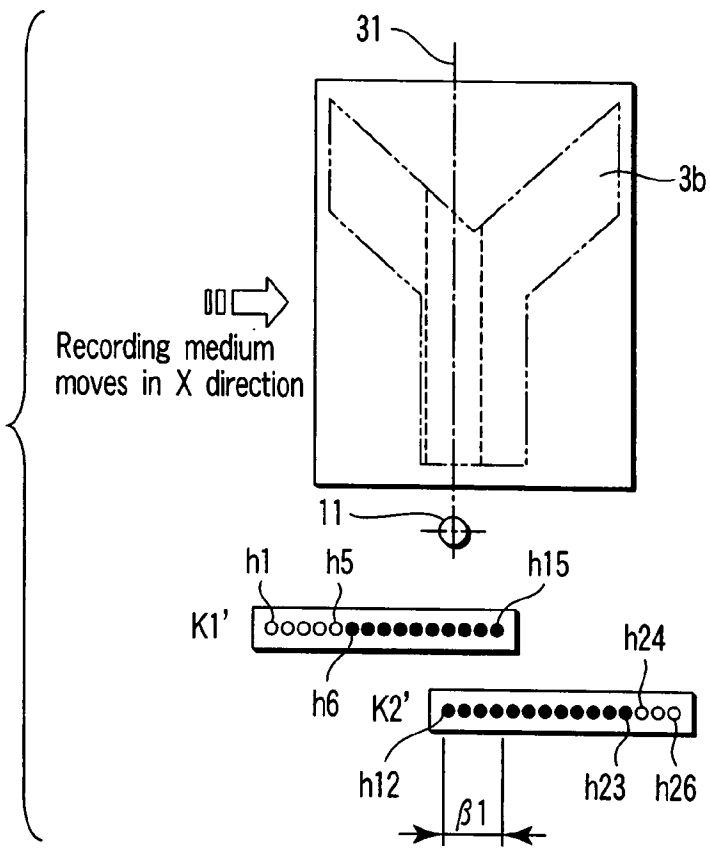
FIG. 7B is a diagram for explaining validity and invalidity of each of the plural ink nozzles in each recording head in a state in which the conveyed recording medium is deviated laterally in the image recording apparatus in which respective nozzle columns of two short-length recording heads are disposed such that they overlap in the conveying direction of the recording medium.
Figure 7A:
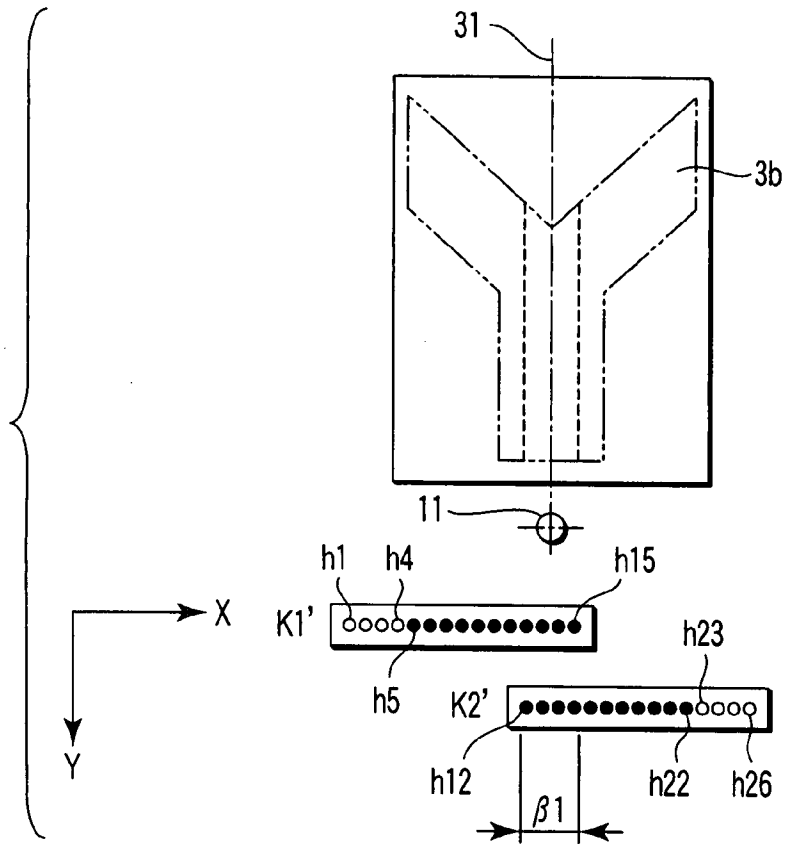
FIG. 7A is a diagram for explaining validity and invalidity of each of the plural ink nozzles in each recording head in a state in which the conveyed recording medium is not deviated laterally in the image recording apparatus in which respective nozzle columns of two short-length recording heads are disposed such that they overlap in the conveying direction of the recording medium.

FIG. 7A shows a condition in which no lateral deviation is found in the above-mentioned lateral deviation detection, and addresses of plural nozzles in the K1' nozzle column and K2' nozzle column without the lateral deviation are set up by the recording position X-direction moving circuit 8-1*a* of FIG. 3.

In FIG. 7A, ink nozzles h1 to h4 and h23 to h26 indicate white data processing in which no ink is ejected. FIG. 7B shows a condition in which as a result of detecting the lateral deviation of the recording medium 21' by the recording medium both-lateral ends detecting section 12 (not shown), the addresses of the plural nozzles in the K1' nozzle column and K2' nozzle column with the recording medium 21 deviated laterally to the right are set up (address setting is changed). In FIG. 7B, ink nozzles h1 to h5 and h24 to h26 indicate white data processing in which no ink is ejected.

Figure 8:
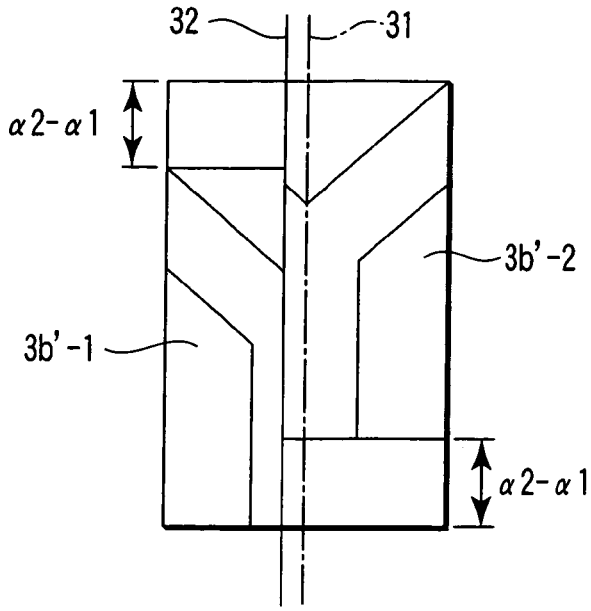
FIG. 8 is a conceptual diagram for explaining image data to be stored and a distribution processing section for the image data under the image recording condition of FIG. 7B (non-image recording data region masking processing is not yet executed)

FIG. 8 shows a state in which partial image data is distributed for storage.

The distribution processing section 9-1*a* for the image data obtains a border position 32 of the joint β1 of the full line image data 3*b* based on processing information of the recording position X-direction moving circuit 8-1*a* of FIG. 3. With the border position as a boundary, partial image data 3*b*'-1 and partial image data 3*b*'-2 are distributed, both being supplied (the above-described one data processing method) with the line image data region (1-line image data corresponds to a pulse of the rotary encoder) corresponding to α2-α1 of a separation distance (pulse number of rotary encoder) between the K1' nozzle column and the K2' nozzle column.

Figure 9:
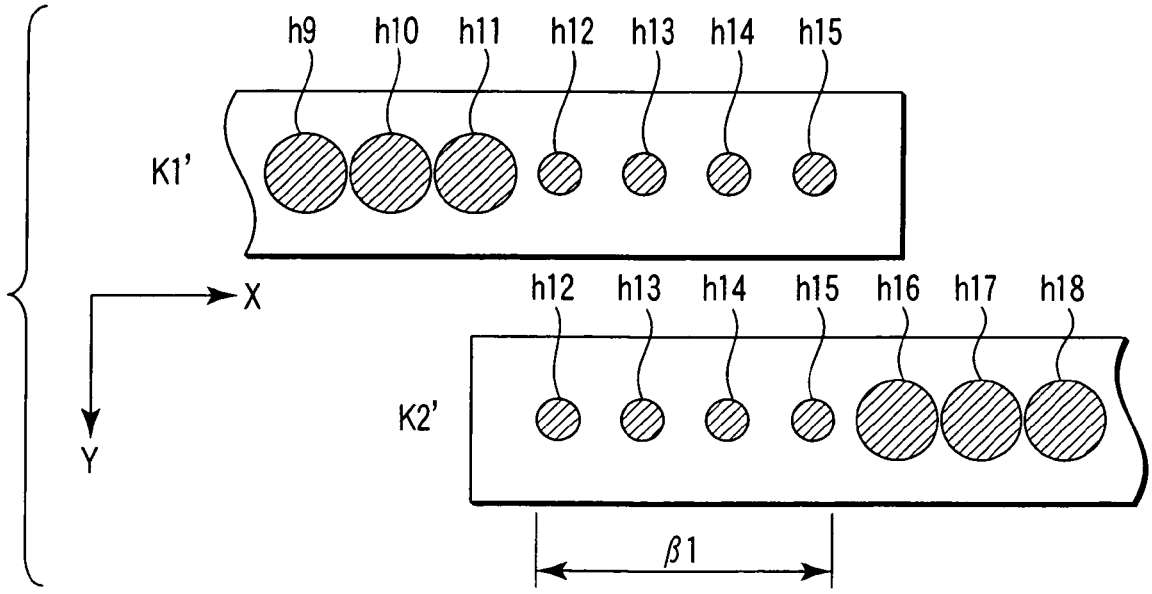
FIG. 9 is a conceptual diagram for explaining density adjustment processing for each nozzle at a joint portion of an image in the image recording apparatus in which the respective nozzle columns of two short-length recording heads are disposed such that they overlap in the conveying direction of the recording medium.

FIG. 9 shows a state in which the number of times of ink ejection is reduced as compared with usually to nozzles h12 to h15 located on the joint β1 by the first image-recording density-varying processing section 9-1*b* and the second image-recording density-varying processing section 9-1*c* of FIG. 3, in which nozzles between the K1' nozzle column and the K2' nozzle column are overlapped with each other in the Y direction.

Figure 10:
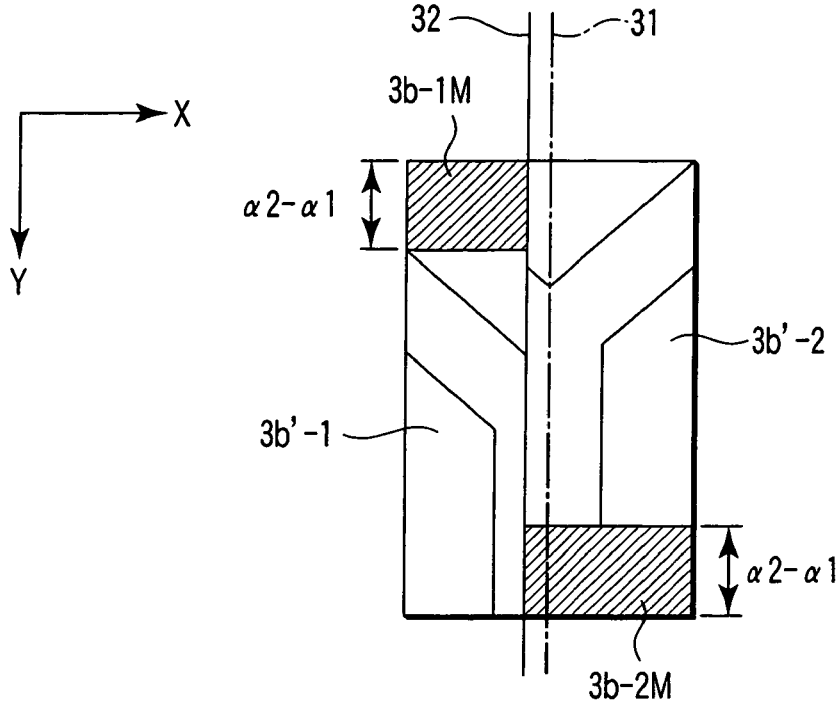
FIG. 10 is a diagram for explaining image data to be stored and a distribution processing section for the image data under the image recording condition of FIG. 7B (non-image recording data region masking processing is executed)

FIG. 10 shows a state in which the first non-image recording data region masking processing section 10-1*b* and the second non-image recording data region masking processing section 10-1*c* of FIG. 3 set up mask for parts of storage regions 3*b*-1M and 3*b*-2M in the image data 3*b*'-1, 3*b*'-2 in the process of FIG. 8.

Figure 11:
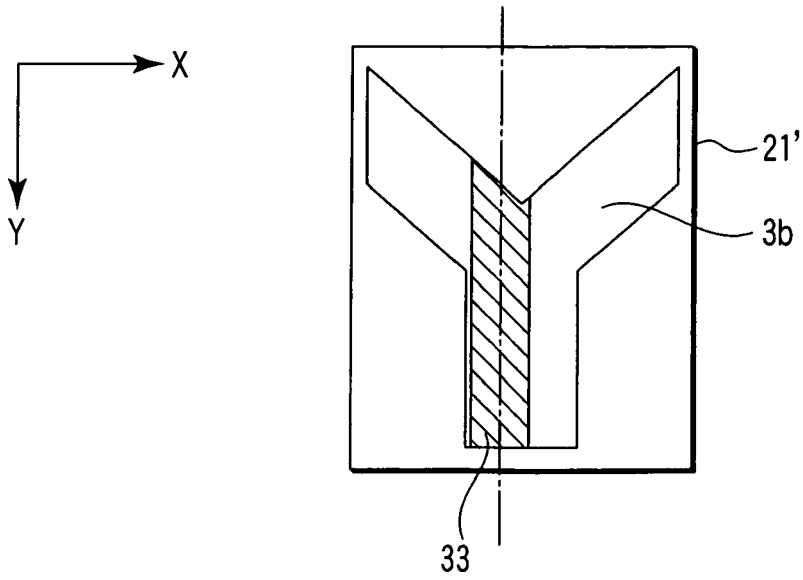
FIG. 11 is a diagram showing image data recorded on a recording medium under the image recording condition of FIG. 7B.

FIG. 11 shows a state in which the drive circuits 17A-1, 17B-1 of the recording unit are driven by the first non-image recording data region masking processing section 10-1*b* and the second non-image recording data region masking processing section 10-1*c* of FIG. 3, so that the image data 3*b* is recorded on the recording medium 21' by the K1' nozzle column and the K2' nozzle column. Reference numeral 33 of the same Figure indicates the image-recording density-varying processing region set up in the process of FIG. 9.

Figure 12:
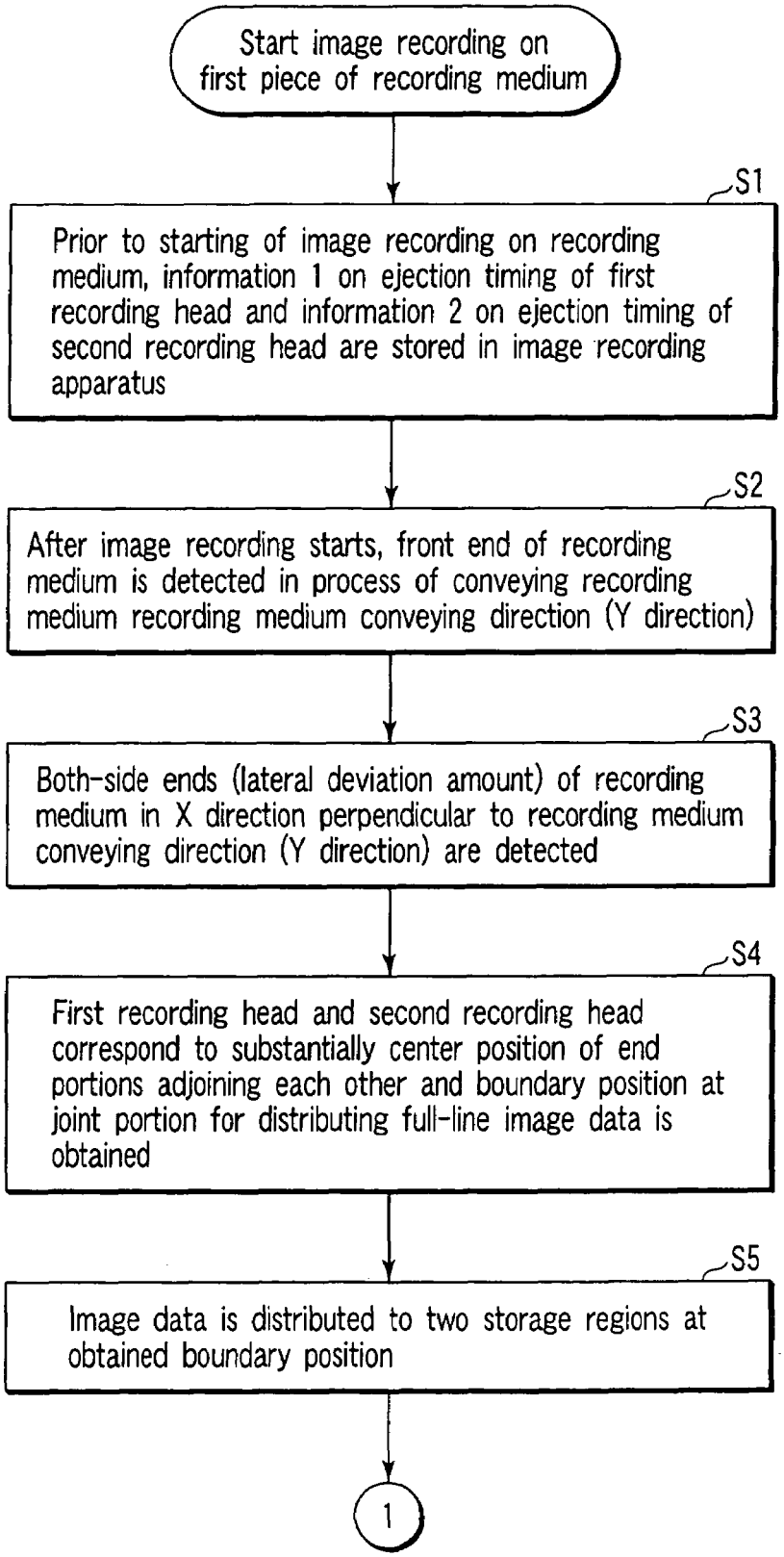
FIG. 12 shows the first half of a flow chart for explaining image recording operation of the image recording apparatus according to the embodiment.
Figure 13:
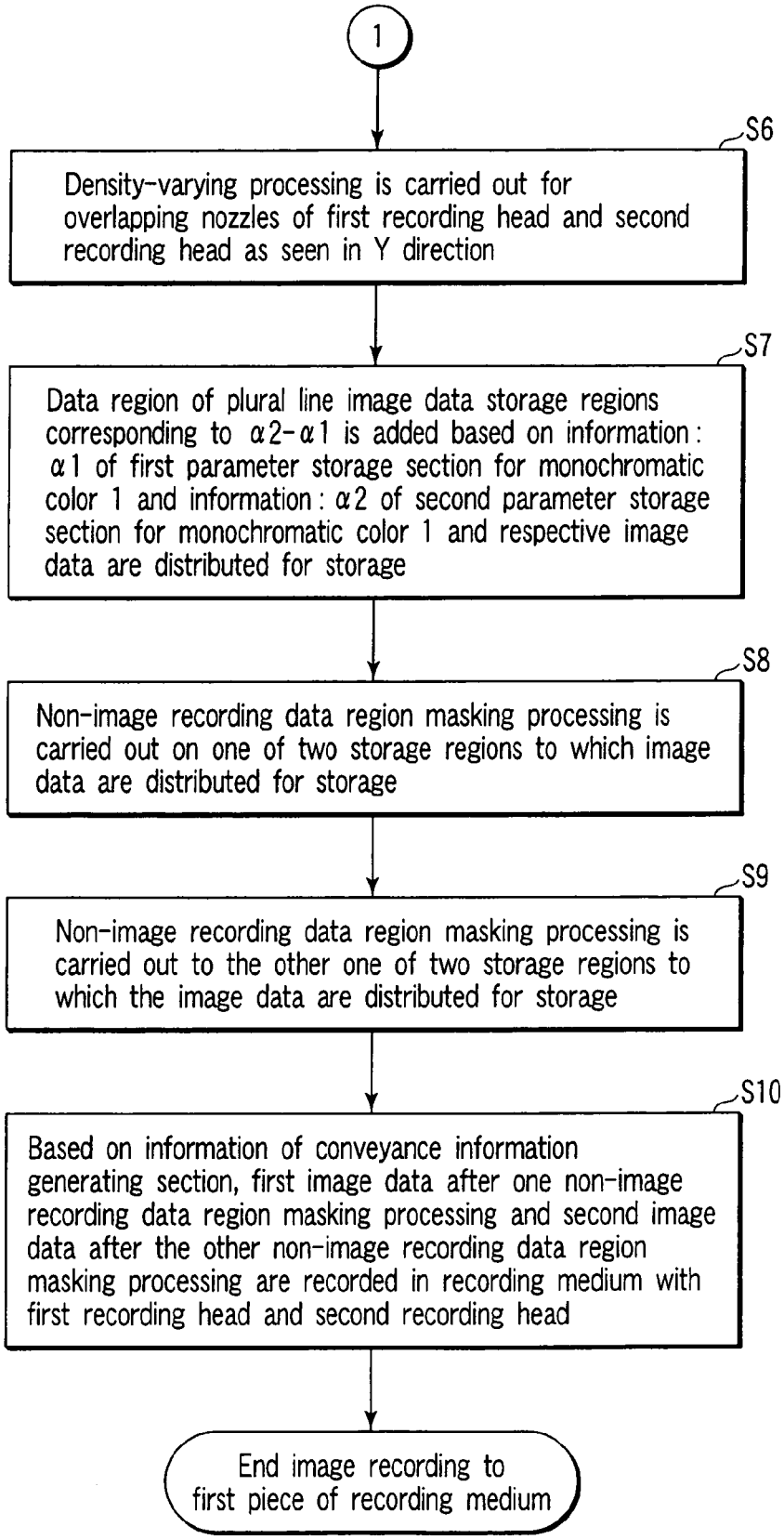
FIG. 13 is a diagram showing the second half of the flow chart for explaining the image recording operation of the image recording apparatus according to the embodiment.

Next, the image recording operation of the image recording apparatus will be described with reference to the flow chart shown in FIGS. 12 and 13. FIGS. 12 and 13 shown a process until image recording of the image data 3*b* shown in FIG. 6 is completed to a single piece of the recording medium 21' in the image recording apparatus shown in FIG. 2.

In step 1, before the image recording to the recording medium is started, at least information 1 on the ejection timing of the first recording head and information 2 on the ejection timing of the second recording head are stored in the image recording apparatus. In step 2, when the recording medium is conveyed in the recording medium conveying direction (Y direction) by starting the image recording, the front end of the recording medium is detected.

In step 3, the both-lateral ends (lateral deviation amount) of the recording medium in the X direction perpendicular to the recording medium conveying direction (Y direction) are detected. In step 4, a boundary position is obtained at a joint corresponding to a substantially center position of end portions of the first recording head and second recording head adjoining each other and for distributing the full line image data.

In step 5, image data is distributed to two storage regions at the obtained boundary position. In step 6, the nozzles of the first recording head and the second recording head execute image-recording density-varying processing on nozzles overlapping each other in the Y direction.

In step 7, a data region of plural line image data storage regions corresponding to α2-α1 is added based on information: α1 of the first parameter storage section for monochromatic color 1 and in-formation: α2 of the second parameter storage section for monochromatic color 1, and respective image data are distributed for storage. In step 8, the non-image recording data region masking processing is carried out on one of two storage regions to which the image data are distributed.

In step 9, the non-image recording data region masking processing is carried out to the other one of the two storage regions to which the image data are distributed. In step 10, based on information of the conveyance information generating section, the first image data after the masking processing of the one non-image recording data region and the second image data after the other non-image recording data region masking processing are recorded in the recording medium with the first recording head and the second recording head.

With the above-mentioned steps S1 to S10, the image recording to the recording medium in the image recording apparatus of the present invention is completed.

Next, a first modification of this embodiment will be described. In the embodiment described previously, a recording unit constituted of short-length recording heads disposed such that their nozzle columns overlap each other in the Y direction has been exemplified. However, if a distance between a nozzle and an adjoining nozzle of the short-length recording heads is equal to an interval between the nozzle columns, it is not necessary to cause the nozzle columns to overlap each other.

Figure 15:
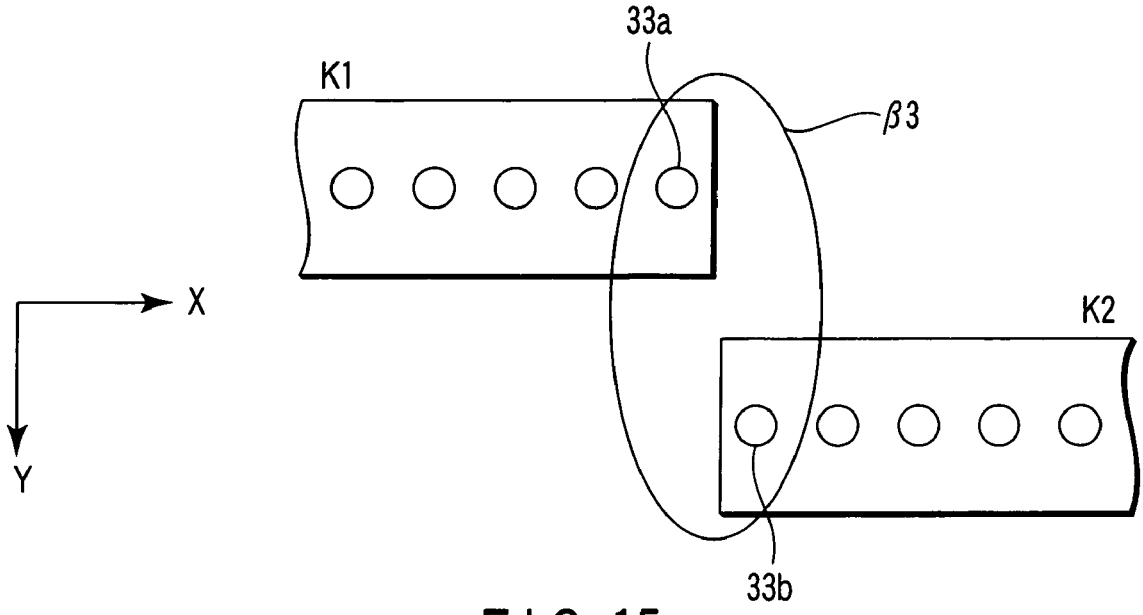
FIG. 15 is a diagram showing an arrangement example in which the plural short-length recording heads are disposed such that the nozzle columns are arranged at an equal interval in the conveying direction.

FIG. 15 shows an example in which in a joint portion β3 of the full line image data recorded by nozzle columns of the K1 recording head and K2 recording head, a nozzle 33*a* and a nozzle 33*b* are separated with a predetermined distance as an interval in the Y direction, while that predetermined distance meets a nozzle pitch of the recording head in the X direction.

In this case, because dots of ink ejection from the nozzles 33*a*, 33*b* do not overlap each other on the recording medium, the process (image-recording density-varying processing) of the step 6 in FIGS. 12 and 13 is not necessary.

Next, a second modification of the present embodiment will be described.

Figure 16:
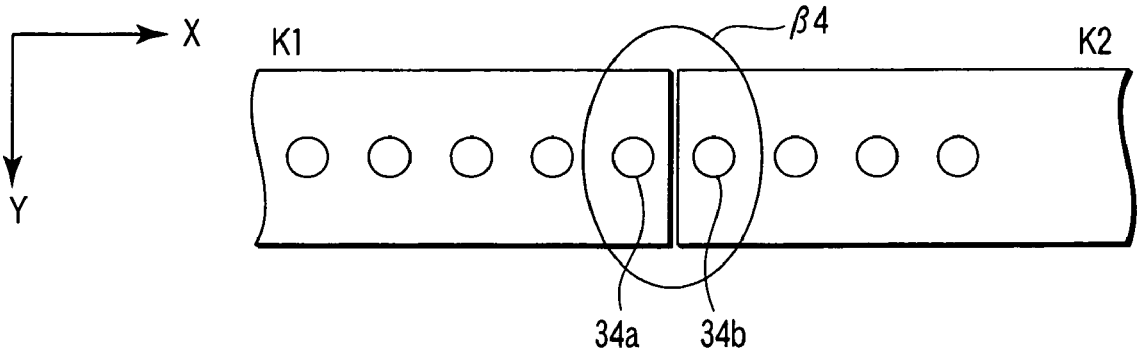
FIG. 16 is a diagram showing an arrangement example in which the plural short-length recording heads are disposed such that the nozzle columns are arranged at an equal interval in the conveying direction in a different way from FIG. 14.

FIG. 16 shows a configuration in which when an image is recorded with nozzle columns of the K1 recording head and K2 recording head, a nozzle 34*a* and a nozzle 34*b* are disposed on a straight line in the X direction at a joint β4 of the full line image data. Because, in this case, the nozzle 34*a* and nozzle 34*b* do not allow dots formed with ink ejected onto the recording medium to overlap each other, the process (image-recording density-varying processing) of the step 6 in FIGS. 12 and 13 is not necessary.

According to the above-described embodiment, in the image recording apparatus having loaded thereon the recording unit in which nozzle columns of plural short-length recording heads are disposed along the X direction and in the back and forth direction along the conveying direction (Y direction) while ends of the respective nozzle columns overlap each other, the image recording position of the image data 19 recorded on the recording medium 21 can be changed by the recording position X-direction moving sections 8-1 to 8-n based on a result of detection of the lateral deviation of the recording medium 21, the surrounding of the conveying mechanism of the image recording apparatus can be prevented from being stained by ink ejection of the recording heads not opposing the recording medium 21.

According to this embodiment, the image-recording density-varying processing can be set up to nozzles corresponding to a joint of the full line image data when the recording heads 18A-1, 18B-1 of the recording head 16-1 to the recording heads 18A-1, 18B-1 of the recording unit 16-n are provided, by the image data distributing sections 9-1 to 9-n, based on respective move information of the recording position X-direction moving sections 8-1 to 8-n. Therefore, by controlling - nozzles corresponding to each joint in terms of ink ejection amount or the number of times of ejection, excellent image recording in which a difference in density is relaxed can be executed to the joint portion in the full line image data recorded on the recording medium.

According to this embodiment, with a joint portion in the full line image data as a boundary position when the recording heads 18A-1, 18B-1 of the recording unit 16-1 to the recording heads 18A-n, 18B-n of the recording unit 16-n are provided, based on respective move information of the recording position X-direction moving section 8-1 to 8-n, the recording heads 18A-1 to 18A-n of the recording unit 16-1 to 16-n and the recording heads 18B-1 to 18B-n of the recording unit 16-1 to 16-n are shifted to each other by plural line image data regions corresponding to a separation distance therebetween by the image data distributing sections 9-1 to 9-n so as to distribute the image data 19 for storage, and thereafter, the recording position Y-direction moving sections 10-1 to 10-n set up the image-recording density-varying processing for each joint. After adding this setting, the image data 19 is recorded by driving the recording heads 18A-1, 18B-1 of the recording unit 16-1 to the recording head 18A-n, 18B-n of the recording unit 16-n with the first recording head drive circuit 17A-1 for monochromatic color 1 and the second recording head drive circuit 17B-1 of the recording unit 16-1 to the first recording head drive circuit 17A-n for monochromatic color n and the second recording head drive circuit 17B-n for monochromatic color n, so that high precision image data joining processing and density processing on the joints are carried out appropriately and then, the image data 19 is recorded on the recording medium 21.

According to this embodiment, the image data processing of shifting the first image data and second image data to be distributed for storage and the non-image recording data region masking processing adopt a data transfer method of developing one-line image data of the image data 19 stored on the same row in the direction of column for data write and data read, whereby the data processing can be carried out rapidly. Further, because this circuit configuration is relatively simple, it can be built up at cheap price.

According to this embodiment, the image recording position on the recording medium is moved corresponding to a deviation (lateral deviation amount) of a conveyed recording medium, when the full line image recording is carried out with plural short-length recording heads, the image data distribution processing is carried out accurately at a joint in an overlapping in the Y direction of the nozzle columns of adjoining short-length recording heads and appropriate density processing is carried out for the joint. As a consequence, it is possible to provide an image recording apparatus capable of recording high quality images and an image recording method of the image recording apparatus.

What is claimed is:

1. An image recording apparatus comprising:

a conveying mechanism comprising a conveyance information generating section which generates conveyance information of a recording medium when the recording medium is mounted and conveyed in a conveying direction;

at least one recording unit, which ejects monochromatic ink, and which comprises a recording head drive circuit and a plurality of recording heads each having a plurality of nozzles which are arranged along a perpendicular direction that is perpendicular to the conveying direction, the recording heads being disposed in one of: (i) a first disposition in which end portions of the recording heads that are adjacent to each other in the perpendicular direction are located on a straight line along the perpendicular direction, and (ii) a second disposition in which the end portions of the recording heads that are adjacent to each other in the perpendicular direction are spaced apart from each other by a predetermined distance in the conveying direction;

a recording medium front end detecting section which detects a front end of the recording medium;

a recording medium both-lateral ends detecting section which detects both lateral ends of the recording medium; and an integral control section which controls the conveying mechanism, and which controls the recording unit based on information from the conveyance information generating section, information from the recording medium front end detecting section, and information from the recording medium both-lateral ends detecting section, to record image data on the recording medium as an image;

wherein the integral control section comprises:

a variable processing section which is configured to select a nozzle to eject the ink from the plurality of nozzles of each of the recording heads in the recording unit based on the information from the recording medium both-lateral ends detecting section, and which is configured to control an ejection timing of each nozzle column formed by the plurality of nozzles; and a control section which receives the image data and controls the variable processing section based on the information from the conveyance information generating section with at least the information from the recording medium detecting section as trigger information;

wherein the control section comprises:

a parameter storage section for each of the recording heads of the recording unit, the parameter storage section storing information on the ejection timing of the nozzle column of each recording head;

a plain memory which stores the image data; and a central processing unit which controls at least the parameter storage section and the plain memory; and wherein the information on the ejection timing on the nozzle column of each of the recording heads comprises an adjustment value based on the design of the image recording apparatus.

2. An image recording apparatus comprising:

a conveying mechanism comprising a conveyance information generating section which generates conveyance information of a recording medium when the recording medium is mounted and conveyed in a conveying direction;

at least one recording unit, which ejects monochromatic ink, and which comprises a recording head drive circuit and a plurality of recording heads each having a plurality of nozzles which are arranged along a perpendicular direction that is perpendicular to the conveying direction, the recording heads being disposed in one of: (i) a first disposition in which end portions of the recording heads that are adjacent to each other in the perpendicular direction are located on a straight line along the perpendicular direction, and (ii) a second disposition in which the end portions of the recording heads that are adjacent to each other in the perpendicular direction are spaced apart from each other by a predetermined distance in the conveying direction;

a recording medium front end detecting section which detects a front end of the recording medium;

a recording medium both-lateral ends detecting section which detects both lateral ends of the recording medium; and an integral control section which controls the conveying mechanism, and which controls the recording unit based on information from the conveyance information generating section, information from the recording medium front end detecting section, and information from the recording medium both-lateral ends detecting section, to record image data on the recording medium as an image;

wherein the integral control section comprises:

a variable processing section which is configured to select a nozzle to eject the ink from the plurality of nozzles of each of the recording heads in the recording unit based on the information from the recording medium both-lateral ends detecting section, and which is configured to control an ejection timing of each nozzle column formed by the plurality of nozzles; and a control section which receives the image data and controls the variable processing section based on the information from the conveyance information generating section with at least the information from the recording medium detecting section as trigger information;

wherein the variable processing section comprises at least one monochromatic color variable processing section corresponding respectively to the at least one recording unit which ejects the monochromatic ink; and wherein the monochromatic color variable processing section comprises:

a recording position X-direction moving section which moves an image recording position by the recording unit in the direction perpendicular to the conveying direction;

an image data distributing section which distributes the image data as first image data for a first recording head of the recording heads of the recording unit and second image data for a second recording head of the recording heads of the recording unit; and a recording position Y-direction moving section which stores each said distributed image data based on the information from the conveyance information generating section.

3. The image recording apparatus according to claim 2, wherein the recording position X-direction moving section comprises a recording position X-direction moving circuit.

4. The image recording apparatus according to claim 2, wherein the recording position X-direction moving section sets up whether ink ejection is valid or invalid for each of the plurality of nozzles in each of the recording heads of the recording unit which ejects the monochromatic ink.

5. The image recording apparatus according to claim 2, wherein the recording heads of the recording unit are arranged in the second disposition, and the end portions of the recording heads that are adjacent to each other in the perpendicular direction overlap each other along the conveying direction; and wherein the image data distributing section includes:

an image data distribution processing section;

a first image-recording density-varying processing section which varies sizes of ink droplets ejected from overlapping nozzles in the first recording head, which overlap along the conveying direction with nozzles in the second recording head; and a second image-recording density-varying processing section which varies sizes of ink droplets ejected from the overlapping nozzles of the second recording head.

6. The image recording apparatus according to claim 2, wherein the image data distributing section sets up a boundary position for distributing the image data to the first recording head and the second recording head and distributes the image data as the first image data and the second image data at the boundary position.

7. The image recording apparatus according to claim 2, wherein the recording position Y-direction moving section comprises:

a recording position Y-direction moving circuit;

a first non-image recording data region masking processing section which generates image data for the first recording head to record an image with respect to the image data;

a first recording head drive synchronous signal generating circuit which generates a drive synchronous signal of the first recording head and notifies at least the first non-image recording data region masking processing section;

a second non-image recording data region masking processing section which generates image data for the second recording head to record an image with respect to the image data; and a second recording head drive synchronous signal generating circuit which generates a drive synchronous signal of the second recording head and notifies the second non-image recording data region masking processing section.

8. The image recording apparatus according to claim 7, wherein the first non-image recording data region masking processing section and the second non-image recording data region masking processing section execute data masking processing for a storage region configured to store a plurality of 1-line image data corresponding to a difference between the ink ejection timing of the first recording head and the ink ejection timing of the second recording head.

9. The image recording apparatus according to claim 2, wherein the recording position Y-direction moving section comprises a storage region configured to store a plurality of 1-line image data corresponding to a difference between an ink ejection timing of the first recording head and an ink ejection timing of the second recording head, in a storage region for the first image data and the second image data.

10. The image recording apparatus according to claim 2, wherein, for the first image data and the second image data distributed and stored in individual storage regions, the recording position Y-direction moving section reads out the second image data based on the information from the conveyance information generating section at the ink ejection timing of the second recording head, and then reads out the first image data after a timing of a difference between the ink ejection timing of the first recording head and the ink ejection timing of the second recording head elapses.

11. The image recording apparatus according to claim 10, wherein, when the ink ejection timing of the first recording head is $\alpha 1$ and the ink ejection timing of the second recording head is $\alpha 2$, a timing $\Delta\alpha$ of the difference between the ink ejection timing of the first recording head and the ink ejection timing of the second recording head is $\Delta\alpha=\alpha 2-\alpha 1$, and the timing $\Delta\alpha$ is a number of encoder pulses of the conveyance information generating section.

12. The image recording apparatus according to claim 2, wherein the recording position Y-direction moving section stores each said image data distributed by the image data distributing section by shifting an address of a data memory or a read-out timing of each said image data stored in the data memory.

13. The image recording apparatus according to claim 2, wherein the recording position Y-direction moving section executes data masking processing on image data at a portion exceeding a size of the recording medium in the conveying direction.

14. An image recording method for an image recording apparatus, wherein the image recording apparatus comprises: (i) a conveying mechanism comprising a conveyance information generating section which generates conveyance information of a recording medium when the recording medium is mounted and conveyed in a Y direction, and (ii) at least one recording unit, which ejects monochromatic ink, and which comprises a plurality of recording heads each having a plurality of nozzles which are arranged along an X direction that is perpendicular to the Y direction, the recording heads being disposed in one of a first disposition in which end portions of the recording heads that are adjacent to each other in the X direction are located on a straight line, and a second disposition in which the end portions of the recording heads that are adjacent to each other in the X direction are spaced apart from each other by a predetermined distance in the Y direction, wherein said at least one recording unit ejecting a monochromatic ink from said plurality of nozzles, and wherein image recording is executed in a process of conveying the recording medium with the conveying mechanism based on inputted image data, the image recording method comprising:

storing at least first information concerning an ink ejection timing of a first recording head of the plurality of recording heads of the recording unit and second information concerning an ink ejection timing of a second recording head of the plurality of recording heads of the recording unit, before the image recording is started;

detecting a front end of the recording medium conveyed in the Y direction after the image recording is started;

detecting both lateral ends of the conveyed recording medium in the X direction;

obtaining a boundary position in the X direction for distributing the image data as first image data to the first recording head and second image data to the second recording head based on a result of the detection of said both lateral ends;

distributing the image data as the first image data and the second image data and storing at the obtained boundary position;

reading out the first image data and the second image data by shifting read timings thereof only by an amount of line image data corresponding to a difference in the ink ejection timings of the first recording head and the second recording head, based on the conveyance information; and recording an image on the recording medium by the first recording head and the second recording head.

15. The image recording method of an image recording apparatus according to claim 14, wherein nozzles of the first recording head and the second recording head overlap each other along the Y direction, and the method further comprises:

executing first image-recording density correction processing on the overlapping nozzles of the first recording head and second image-recording density correction processing on the overlapping nozzles of the second recording head.

16. The image recording method of an image recording apparatus according to claim 14, wherein the information concerning the ejection timing of said each recording head comprises an adjustment value based on the design of the image recording apparatus.

17. An image recording method for an image recording apparatus, wherein the image recording apparatus comprises: (i) a conveying mechanism comprising a conveyance information generating section which generates conveyance information of a recording medium when the recording medium is mounted and conveyed in a Y direction, and (ii) at least one recording unit, which ejects monochromatic ink, and which comprises a plurality of recording heads each having a plurality of nozzles which are arranged along an X direction that is perpendicular to the Y direction, the recording heads being disposed in one of a first disposition in which end portions of the recording heads that are adjacent to each other in the X direction are located on a straight line, and a second disposition in which the end portions of the recording heads that are adjacent to each other in the X direction are spaced apart from each other by a predetermined distance in the Y direction, wherein said at least one recording unit ejecting a monochromatic ink from said plurality of nozzles, and wherein image recording is executed in a process of conveying the recording medium with the conveying mechanism based on inputted image data, the image recording method comprising:

storing at least first information concerning an ink ejection timing of a first recording head of the plurality of heads of the recording unit and second information concerning an ink ejection timing of a second recording head of the plurality of recording heads of the recording unit, before the image recording is started;

detecting a front end of the recording medium conveyed in the Y direction after the image recording is started;

detecting both lateral ends of the conveyed recording medium in the X direction;

obtaining a boundary position in the X direction for distributing the image data as first image data to the first recording head and second image data to the second recording head based on a result of the detection of said both lateral ends;

adding a data region only by an amount of a plurality of line image data corresponding to a difference in the ejection timings of the first recording head and the second recording head, and distributing the image data as the first image data and the second image data and storing;

executing first non-image recording data region masking processing for the first image data and second non-image recording data region masking processing for the second image data based on the conveyance information; and recording, after said each non-image recording data region masking processing, the first image data and the second image data on the recording medium as an image by the first recording head and the second recording head based on the conveyance information.

18. The image recording method of an image recording apparatus according to claim 17, wherein nozzles of the first recording head and the second recording head overlap each other along the Y direction, and the method further comprises:

executing first image-recording density correction processing on the overlapping nozzles of the first recording head and second image-recording density correction processing on the overlapping nozzles of the second recording head.

19. The image recording method of an image recording apparatus according to claim 17, wherein the information concerning the ejection timing of said each recording head comprises an adjustment value based on the design of the image recording apparatus.

* * * * *